US005733715A

United States Patent [19]

Verbeeck et al.

[11] Patent Number: 5,733,715

[45] Date of Patent: Mar. 31, 1998

[54] SILVER HALIDE PHOTOGRAPHIC MATERIALS COMPRISING SILVER BROMIDE OR BROMOIODIDE EMULSIONS HAVING TRIANGULAR TABULAR CRYSTALS

[75] Inventors: Ann Verbeeck, Begijnendijk; Peter Verrept, Avelgem, both of Belgium

[73] Assignee: Agfa-Gevaert, N.V., Mortsel, Belgium

[21] Appl. No.: 680,406

[22] Filed: Jul. 15, 1996

[30] Foreign Application Priority Data

Jul. 18, 1995 [EP] European Pat. Off. ..... 95201973

[51] Int. Cl.[6] ..... G03C 1/005; G03C 1/035; G03C 1/015; G03C 1/07

[52] U.S. Cl. ..... 430/567; 430/569

[58] Field of Search ..... 430/567, 569

[56] References Cited

U.S. PATENT DOCUMENTS

| | | | |
|---|---|---|---|
| 4,797,354 | 1/1989 | Saitou et al. | 430/567 |
| 5,017,469 | 5/1991 | Mowforth et al. | 430/569 |

FOREIGN PATENT DOCUMENTS

| | | | |
|---|---|---|---|
| 0392092 | 10/1990 | European Pat. Off. | G03C 1/04 |
| 2534036 | 4/1984 | France | G03C 1/02 |
| 3-238443 | 10/1991 | Japan | G03C 1/035 |

*Primary Examiner*—Mark F. Huff

*Attorney, Agent, or Firm*—Breiner & Breiner

[57] ABSTRACT

A light-sensitive silver bromide or silver bromoiodide emulsion is provided, comprising silver bromide or silver bromoiodide tabular triangular grains, said tabular triangular grains having an average grain thickness of less than 0.3 μm, an average crystal diameter of at least 0.6 μm; an average aspect ratio of at least 2:1; a variation coefficient of less than 40%, said grains accounting for a total projective area of at least 30%; characterized in that the thickness ratio of triangular tabular grains to hexagonal tabular grains is from 1.3 to 0.7.

10 Claims, No Drawings

SILVER HALIDE PHOTOGRAPHIC MATERIALS COMPRISING SILVER BROMIDE OR BROMOIODIDE EMULSIONS HAVING TRIANGULAR TABULAR CRYSTALS

This application claims the benefit of U.S. Provisional application Ser. No. 60/003,587 filed Sep. 12, 1995.

FIELD OF THE INVENTION

The present invention relates to a silver halide emulsions comprising tabular triangular crystals, to the preparation method thereof and to light-sensitive silver halide photographic materials containing said emulsions.

BACKGROUND OF THE INVENTION

The effects of various precipitation conditions on the formation of silver halide emulsions comprising tabular crystals have been studied extensively as the said tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes U.S. application Ser. Nos. 4,063,951; 4,067,739; U.S. Pat. Nos. 4,150,994; 4,184,877 and 4,184,878. However the tabular grains described herein cannot be regarded as showing a high diameter to thickness ratio, commonly called aspect ratio. In a number of U.S. applications filed in 1981 and issued in 1984 tabular grains with high aspect ratio and their advantages in photographic applications are described as e.g. in U.S. applications Ser. Nos. 4,434,226; 4,439,520; 4,425,425; 4,425,426 and 4,433,048. A survey on high aspect ratio silver halide emulsions appeared in Research Disclosure, Vol 225, Jan 1983, Item 22534. The above cited references on tabular grains are mainly concerned with high sensitive silver bromide or silver iodobromide emulsions.

The anisotropic growth of the said tabular grains is due to the formation of parallel twin planes in the nucleation step of the precipitation.

The shape of the tabular grains may be variable: triangular, hexagonal, disc-shaped, trapezoidal and even needle-shaped grains can be formed. The said shape can be regular or irregular.

The appearance of triangular or hexagonal grains is mainly concerned with the number of twin planes: it has been observed that an uneven number of twin planes leads to a triangular shape of the grains, whereas an even number leads to a hexagonal shape, whereas the appearance of trapezoidal and needle-shaped grains is related with the coalescence phenomena or the formation of non-parallel twin planes. These topics have been discussed in J. Imag. Sci. 31, 1987,p. 15–26 and p. 93–99.

Emulsion preparation of tabular grains by means of the methods well-known by a person skilled in the art of photography leads to grain populations consisting of a mixture of all shapes of crystals described hereinbefore.

As a consequence many attempts have been made in order to improve the degree of homogeneity of the size and shape of the crystals. In this context EP-A's 566 076; 506 947; 518 066 and 513 722 and U.S. application Ser. No. 4,797,354 are related with the preparation of monodisperse hexagonal tabular crystals, respectively with the preparation of tabular emulsions having a high percentage (at least 90%) of hexagonal, tabular crystals.

Hitherto however, a preparation method of emulsions having a homogeneous crystal distribution, being composed of thin tabular triangular silver bromide or bromoiodide crystals has never been disclosed yet.

OBJECTS OF THE INVENTION

Therefore it is an object of the present invention to provide tabular triangular emulsions, a method to prepare the said emulsions and silver halide photographic materials comprising emulsions having silver bromide or silver bromoiodide tabular triangular grains.

Other objects will become apparent from the description hereinafter.

SUMMARY OF THE INVENTION

According to this invention a light-sensitive silver bromide or silver bromoiodide emulsion is provided, comprising silver bromide or silver bromoiodide tabular triangular grains, said tabular triangular grains having an average grain thickness of less than 0.3 μm, an average crystal diameter of at least 0.6 μm; an average aspect ratio of at least 2:1; a variation coefficient of less than 40%, said grains accounting for a total projective area of at least 30%; characterized in that the thickness ratio of triangular tabular grains to hexagonal tabular grains is from 1.3 to 0.7.

According to this invention a method is further provided to prepare emulsions comprising said triangular tabular grains as disclosed hereinbefore comprising the steps of:

precipitating silver bromide or silver bromoiodide by means of a double-jet or triple-jet technique applied to aqueous solutions of silver nitrate and halide salts in the presence of at least one protective colloid, being preferably gelatin and/or colloidal silica, in the presence of at least one onium compound, preferably a phosphonium compound, wherein a ratio by weight of onium compound(s) to protective colloid(s) is between 0.03 and 0.50, and more preferably between 0.05 and 0.30;

controlling nucleation and growth steps by means of variable flow rates of aqueous solutions of silver nitrate and halide (bromide or bromoiodide) salts and constant pAg-values within the range from 9.5 to 8.0, and more preferably from 9.5 to 8.8 during said steps, at least one physical ripening step between at least nucleation and first growth step, desalting reaction medium and redispersing silver halide, and chemically ripening the silver bromide or bromoiodide grains.

This invention also provides a silver halide light-sensitive photographic material having a support and, provided thereon, at least one hydrophilic colloid layer including at least one light-sensitive emulsion comprising the tabular triangular silver bromide or silver bromoiodide grains as defined hereinbefore.

DETAILED DESCRIPTION OF THE INVENTION

For all crystals having a tabular triangular shape according to this invention, the said shape is considered to be triangular as soon as the length of the smallest side is less than 1/10th of the length of the largest side. According to this invention emulsions are provided comprising tabular triangular silver bromide or silver bromoiodide grains as defined hereinbefore, wherein the said tabular grains have an aspect ratio of at least 2:1. The term "aspect ratio" can be applied as the silver bromide or silver bromoiodide tabular triangular grains of this invention are crystals having two parallel major faces with a ratio between the diameter of a circle having the same area as these faces, and the thickness, which is the distance between the said two parallel faces, being equal to at least 2:1. More preferably said aspect ratio is at least 5:1, and more still more preferably at least 8:1, wherein an average crystal diameter of at least 0.6 μm is preferred; a crystal thickness of less than 0.3 μm, more preferably less than 0.2 μm and a variation coefficient of less than 40% and still more preferably less than 25%.

For radiographic applications the main photographic advantages of tabular grains compared to normal globular grains are a high covering power at high forehardening levels, a high developability and a higher sharpness especially in double side coated spectrally sensitized materials.

The light-sensitive silver halide emulsions comprising tabular grains, and particularly said tabular triangular grains according to this invention, are characterized in the preparation step by the presence of a co-stabilizing onium compound and a protective colloid in a weight ratio (COSI) amount of from 0.03 to 0.5, more preferably in a weight ratio amount of from 0.05 to 0.30 and by a well-defined pAg value range of from 9.5 to 8.0, and more preferably from 9.5 to 8.8, in the nucleation and/or growth step.

For the emulsions prepared according to the method of this invention, the thickness ratio of triangular tabular crystals to hexagonal tabular crystals is from 1.3 to 0.7, as will become apparent from the Examples. This means that an analogous growth mechanism for triangular as for hexagonal crystals is observed when said triangular crystals are prepared according to the method of this invention, opposite to thickness ratios obtained by application of preparation methods according to e.g. FR 2 534 036.

As a protective hydrophilic colloid gelatin or colloidal silica sol is used alone or in a combination of gelatin and colloidal silica sol in the method of this invention. It can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates. The gelatin can be lime-treated or acid-treated gelatin. The preparation of such gelatin types has been described in e.g. "*The Science and Technology of Gelatin*", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966).

In the most preferred embodiment silica sols are used in the method of this invention as a sole protective colloid in the preparation of silver halide emulsions or together with gelatin as set forth hereinbefore. Commercially available silica sols are the "Syton" silica sols (trademarked products of Monsanto Inorganic Chemicals Div.), the "Ludex" silica sols (trademarked products of du Pont de Nemours & Co., Inc.), the "Nalco" and "Nalcoag" silica sols (trademarked products of Nalco Chemical Co), the "Snowrex" silica sols of Nissan Kagaku K. K. and the "Kieselsol, Types 100,200, 300, 500 and 600" (trademarked products of Bayer AG). Particle sizes of the silica sol particles are in the range from 3 nm to 30 μm, but smaller particles in the range from 3 nm to 0.3 μm are preferred.

Variation from the weight ratio amount of the protective colloid(s) versus the co-stabilizing onium compound(s) during the preparation steps that are characterizing the preparation method of this invention can be attained by adding the said compound(s) in two or more portions during the preparation process of the tabular triangular crystals according to this invention. $NH_4^+$—ions are thereby excluded as onium compounds as $NH_4Br$ may be used as a halide salt in the preparation method of emulsion grains of this invention.

As thinner tabular triangular grains provide the advantages mentioned hereinbefore to a larger extent, the grains having silica as a protective colloid according to this invention are preferred having an average grain thickness of not more than 0.3 μm and, more preferably, not more than 0.2 μm. As thinner silver halide emulsion grains comprising silica more easily exhibit a higher aspect ratio, an average aspect ratio of at least 5:1 and, more preferably, of at least 8:1 and still more preferably of at least 12:1 is preferred for the grains (also called crystals) according to this invention.

For emulsions comprising silver bromide or silver bromoiodide tabular triangular grains according to this invention a total projective area of the said grains of at least 70% is highly preferred and a total projective area of at least 90% is even more preferred.

Iodide ions can be provided by an organic iodide salts and/or organic compounds releasing iodide ions as has e.g. been described in EP-A's 0 561 415, 0 563 701, 0 563 708, 0 649 052 and 0 651 284. Iodide ion concentrations up to 10 mole % may be present but concentrations up to 3 mole % are particularly preferred.

The preparation of light-sensitive tabular triangular silver bromide or silver bromoiodide emulsions according to this invention comprises the following steps:

precipitating silver halide by means of the double-jet or triple-jet technique applied to aqueous solutions of silver nitrate and halide salts in a protective colloid, preferably silica and/or gelatin, in the presence of at least one onium compound, wherein a ratio by weight of said onium compound(s) to the said protective colloid(s) is from 0.03 to 0.50, and more preferably from 0.05 to 0.30;

controlling the nucleation and growth steps by means of variable flow rates of aqueous solutions of silver nitrate and halide salts and constant pAg-values within the range from 9.5 to 8.0, and more preferably from 9.5 to 8.8 during said steps, at least one physical ripening step between at least the nucleation and the first growth step, desalting the reaction medium and redispersing the silver halide, chemically ripening the silver halide crystals.

Of the total amount of silver nitrate less than 10% by weight and, more preferably, 0.5% to 5.0% is added during the nucleation step which consists preferably of an addition by means of the double-jet method of silver nitrate and halide salts at a pBr of at least 2.0.

Additional amounts of protective colloid and onium compound(s), may be added to the reaction vessel in one or more portions or continuously in a triple-jet precipitation system. Especially preferred are additions during so called Ostwald ripening stages e.g. before the flow rate of the silver and/or halide solutions is increased in a double-jet precipitation system.

As onium compounds, except for ammonium compounds like e.g. ammonium bromide, the following compounds represented by the following general formulae can be used:

$$A^+X^-$$

wherein $X^-$ represents an anion and $A^+$ represents an onium ion selected from any of the following general formulae:

$$R_2-\overset{R_1}{\underset{R_3}{N^+}}- \quad R_2-\overset{R_1}{\underset{R_3}{P^+}}- \quad \overset{R_1}{\underset{R_2}{S^+}}- \quad \overset{R_1}{\underset{R_2}{Se^+}}- \quad R_1-I^+-$$

and wherein:

each of $R_1$ and $R_3$ (same or different) represents hydrogen (except for ammonium), an alkyl group, a substituted alkyl group, a cycloalkyl group, an aryl group or a substituted aryl group, $R_2$ represents any of the said groups represented by $R_1$ and $R_3$ or the atoms necessary to close a heterocyclic nucleus with either $R_1$ or $R_3$, the said onium ion being linked 1) to a polymer chain, or 2) via a bivalent organic linking group e.g., —O—, —S—, —$SO_2$—, etc., to any other of such onium structure, or 3) directly to any of the groups represented by $R_1$.

Suitable examples of onium compounds are disclosed in U.S. Pat. No. 3,017,270. In said specification suitable examples are mentioned of trialkyl sulfonium salts, polysulfonium salts, tetraalkyl quaternary ammonium salts, quaternary ammonium salts in which the quaternary nitrogen atom is a part of a ring system, cationic polyalkylene oxide salts including e.g. quaternary ammonium and phosphonium and his-quaternary salts.

According to this invention the said onium compounds act as effective crystal habit modifiers for the silver bromide and silver bromoiodide tabular triangular crystals. The action of onium compounds as a crystal habit modifier is more pronounced in the presence of colloidal silica sol, although their influence in the presence of gelatin cannot be neglected.

The photographic emulsions comprising silver bromide and silver bromoiodide tabular triangular crystals, according to the present invention, may have a homogenous or a heterogeneous halide distribution within the crystal volume. A hererogenous halide distribution may be obtained by application of growth steps having a different halide composition or by conversion steps e.g. by addition of iodide ions that provide less soluble silver salts onto existing tabular silver bromide cores or silver bromoiodide cores poor in iodide. In the case of a heterogeneous distribution of bromide and iodide ions a multilayered grain structure is obtained. Obviously the tabular triangular form has to be maintained in this case in order to get tabular triangular emulsion crystals in accordance with this invention.

The crystals may further be doped with whatever a dope as e.g. with $Rh^{3+}$, $Ir^{4+}$, $Cd^{2+}$, $Zn^{2+}$, $Ru^{2+}$ and $Pb^{2+}$.

During precipitation grain growth restrainers or accelerators may be added to obtain crystals with a preferred average crystal size diameter between 0.05 and 5 μm. Examples of grain growth accelerators are compounds carrying e.g. a thioether function.

It is important to avoid renucleation during the growth step of the nuclei formed in the nucleation step by controlling the preferred increasing rate of addition of the silver nitrate and the halide salts and pAg values to make the distribution predictable of the emulsion crystals comprising tabular triangular silver halide grains.

Silver halide nuclei can also be formed in a separate vessel and added to the reaction vessel wherein the growth step is performed. In said reaction vessel additional amounts of protective colloid and onium compound(s) may be present.

In a further stage after the end of the precipitation, desalting and redispersing of the silver bromide or silver bromoiodide tabular triangular emulsion, followed by chemically ripening provides an emulsion that can be prepared for coating in light-sensitive photographic layers of silver halide photographic materials. If necessary one or more spectral sensitizers may be added at any stage of the emulsion preparation. More preferably the said spectral sensitizers are added before chemical sensitization.

The light-sensitive emulsion comprising silver bromide or bromoiodide tabular triangular crystals, prepared in accordance with the present invention is, after redispersion, a so-called primitive emulsion. Chemical sensitization can be performed as described in i.e. "Chimie et Physique Photographique" by P. Glafkides, in "Photographic Emulsion Chemistry" by G. F. Duffin, in "Making and Coating Photographic Emulsion" by V. L. Zelikman et el, and in "Die Grundlagen der Photographischen Prozesse mir Silberhalogeniden" edited by H. Frieser and published by Akademische Verlagsgesellschaft (1968). As described in this literature chemical sensitization can be carried out by effecting the ripening in the presence of small amounts of compounds containing sulphur, selenium and/or tellurium e.g. thiosulphate, thiocyanate, the corresponding selenium and/or tellurium compounds, thioureas, sulphites, mercapto compounds, and rhodenines. The emulsions can be sensitized also by means of gold-sulphur, gold-selenium and/or gold-tellurium ripenets or by means of reductors e.g. tin compounds as described in GB-A 789 823, amines, hydrazinc derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used. A mixture can also be made of two or more separately precipitated emulsions being chemically sensitized before mixing them.

According to this invention chemical ripening is performed before, during or after spectral sensitization. In classical emulsion preparation spectral sensitization traditionally follows the completion of chemical sensitization. However, in connection with tabular grains, it is specifically considered that spectral sensitization occurs simultaneously with or even precedes completely the chemical sensitization step: the chemical sensitization after spectral sensitization is believed to occur at one or more ordered discrete sites of tabular grains. This may also be done with the emulsions of the present invention, wherein the chemical sensitization proceeds in the presence of one or more phenidone and derivatives, a dihydroxy benzene as hydroquinone, resorcinol, catechol and/or a derivative(s) therefrom, one or more stabilizer(s) or antifoggant(s), one or more spectal sensitizer(s) or combinations of said ingredients.

The light-sensitive emulsion comprising silver halide tabular triangular crystals, prepared in accordance with the present invention, may be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534.

An example of a useful spectral sensitizer is anhydro-5,5'-di-chloro-3,3'-bis(n-sulphobutyl)-9-ethyloxacarbocyanine hydroxide or anhydro-5,5'-dichloro-3,3'-bis(n-sulphopropyl)-9-ethyloxacarbo-cyanine hydroxide.

A suitable mixture of spectral sensitizers that can be applied is anhydro-5,5'-dichloro-3,3'-bis(n-sulphobutyl)-9-ethyl oxacarbocyanine hydroxide or anhydro-5,5'-dichloro-3,3'-bis(n-sulphopropyl)-9-ethyloxacarbo-cyanine hydroxide and anhydro-5,5'-dicyano-1,1'-diethyl-3,3'-di(2-acetoxyethyl)ethyl-imidacarbocyanine bromide. Further structures are given in EP-A 0 677 773, which is incorporated herein by reference.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring substituted aminostilbene compounds as described e.g. in U.S. Pat. No. 2,933,390 and U.S. Pat. No. 3,635,721, aromatic organic acid-formaldehyde condensation products as described e.g. in U.S. Pat. No. 3,743,510, cadmium salts, and azaindene compounds.

The ratio by weight of protective colloid to silver halide, expressed as an equivalent amount of silver nitrate, is determined at the stage of precipitation and/or by further addition of protective colloid at the redispersion stage or later.

To the emulsion(s) comprising silver halide tabular triangular grains prepared in accordance with the present invention may be added compounds preventing the formation of fog or stabilizing the photographic characteristics prior to, during or after the chemical ripening thereof or during the production or storage of photographic elements or during the photographic treatment thereof. Mixtures of two or more of these compounds can be used.

Many known compounds can be added as fog-inhibiting agent or stabilizer to the silver halide tabular triangular emulsion crystals. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757; GB-A 1,209,146, JP-Appl. 75–39537, and GB-A 1,500,278, and 7-hydroxy-s-triazolo-[1,5-*a*]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are the compounds described in Research Disclosure N° 17643 (1978), Ch. VI.

The silver halide emulsions prepared in accordance with the present invention can be used to form one or more silver halide emulsion layers coated on a support to form a photographic silver halide element according to well known techniques.

Two or more types of emulsions comprising silver halide tabular triangular grains that have been prepared differently according to this invention can be mixed in at least one emulsion layer for forming a photographic emulsion for use in accordance with the present invention.

The photographic element of the present invention may comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, amino-alkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts.

Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805; 4,038,075 and 4,292,400 and in EP-A's 0 634 688 and EP-A 0 674 215.

The photographic element of the present invention may further comprise various other additives such as e.g. compounds improving the dimensional stability of the photographic element, UV-absorbers, spacing agents, hardeners, and plasticizers as described below.

In accordance with this invention a light-sensitive photographic material, coated from emulsions comprising silver halide tabular crystals having silica as a protective colloid, is provided, having a support and, thereon, at least one hydrophilic colloid layer including at least one light-sensitive silver halide emulsion layer characterized in that said light-sensitive layer comprises at leas% one of said emulsions.

The layers of the photographic element, especially when the binder therein used is gelatin, can be hardened with appropriate hardening agents such as those of the epoxide type, those of the ethylenimine type, those of the vinylsulfone type e.g. 1,3-vinylsulphonyl-2-propanol, bis-(vinyl sulphonyl)-methane, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds, e.g. 1,3,5-triacryloyl-hexahydro-s-triazine, active halogen compounds, e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952 and with the onium compounds as disclosed in EP-A 0 408 143.

The emulsion may be coated on any suitable substrate such as, preferably, a thermoplastic resin e.g. polyethyleneterephthalate, polyethylene naphthalate or a polyethylene coated paper support.

Suitable additives for improving the dimensional stability of the photographic element may be added i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylares, and styrene sulphonic acids.

Plasticizers suitable for incorporation in the emulsions according to the present invention are e.g. glycol, glycerine, or the latexes of neutral film forming polymers including polyvinylacetate, acrylates and methacrylates of lower alkanols e.g. polyethylacrylate and polybutylmethacrylate.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 μm and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Emulsion layers comprising silver halide tabular triangular emulsions prepared in accordance with the present invention, and more particularly thin emulsion layers, are showing remarkable improvements concerning both speed and rapid processability compared to conventional emulsions.

The photographic silver halide tabular triangular emulsions can be used in various types of photographic elements such as i.e. in photographic elements for so-called amateur and professional photography, for graphic arts, diffusion transfer reversal photographic elements, low-speed and high-speed photographic elements, X-ray materials, micrografic materials, etc.

In a preferred embodiment the photographic silver halide emulsions are used in X-ray materials. In X-ray photography a material with a single or a duplitized emulsion layer coated on one or both sides of the support may contain silver halide tabular triangular emulsions according to this invention.

The photographic material may contain several non-light sensitive layers e.g. a protective antistress topcoat layer, one or more backing layers, and one or more intermediate layers eventually containing filter or antihalation dyes that absorb scattering light and thus promote the image sharpness. Suitable light-absorbing dyes used in these intermediate layers are described in e.g. U.S. Pat. Nos. 4,092,168 and 4,311,787; in DE 2,453,217, and GB-Patent 7,907,440. Situated in such an intermediate layer between the emulsion layers and the support there will be only a small negligable loss in sensitivity but in rapid processing conditions decoloration of the filter dye layers may form a problem. Therefor it should be recommended to decrease the thickness of the whole coated layer packet resulting in shorter drying times after washing in the processing cycle. Alternatively the use of intermediate layers situated between emulsion layer(s) and support, reflecting the fluorescent light emitted by the screens may bring a solution.

In the case of color photography the material contains blue, green and red sensitive layers each of which can be single coated, but generally consist of double or even triple layers. Besides the light sensitive emulsion layer(s) the photographic material may contain several light-insensitive layers e.g. a protective antistress layer, one or more backing layers, one or more subbing layers, one or more intermediate layers e.g. filter layers and even an afterlayer containing e.g. the hardening agent(s), the antistatic agent(s), filter dyes for safety-light purposes etc.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents as e.g. titanium oxide and the usual ingredients like hardeners and wetting agents.

The support of the photographic material may be opaque or transparent e.g. a paper support or resin support. When a paper support is used preference is given to one coated at one or both sides with an Alpha-o-lefin polymer e.g. a polyethylene layer which optionally contains an anti-halation dye or pigment. It is also possible to use an organic resin support e.g. cellulose nitrate film, cellulose acetate film, triacetate film, poly(vinyl acetal) film, polystyrene film, poly(ethylene terephthalate) film, polycarbonate film, polyvinylchloride film or poly-Alpha-olefin films such as polyethylene or polypropylene film. The thickness of such organic resin film is preferably comprised between 0.07 and 0.35 mm.

These organic resin supports are preferably coated with a subbing layer which can contain water insoluble particles such as silica or titanium dioxide.

The photographic material containing tabular grains prepared according to the present invention can be image-wise exposed by any convenient radiation source in accordance with its specific application.

Of course processing conditions and composition of processing solutions are dependent from the specific type of photographic material in which the tabular grains prepared according to the present invention are applied. For example in a preferred embodiment of materials for X-ray diagnostic purposes said materials may be adapted to rapid processing conditions, including the steps of developing, fixing, rinsing and drying. Preferably an automatically operating processing apparatus is used provided with a system for automatic regeneration of the processing solutions. The forehardened material may be processed using one-part package chemistry or three-part package chemistry, depending on the processing application determining the degree of hardening required in said processing cycle. Within the scope of this invention applications within total processing times of up to 30 seconds are possible, whereas applications up to 90 seconds are known as common praxis. From an ecological point of view it is even possible to use sodium thiosulphate instead of ammonium thiosulphate and to reduce the regeneration amounts of developer and fixer.

An enhanced speed, especially for short exposure times with high radiation intensity, for the materials coated from silver halide tabular triangular emulsions according to this invention is attained and should be recognized as an exceptional advantage offered by the said emulsion crystals, the growth of which has been site-directed in the presence of the onium compounds referred to hereinbefore.

The following examples being non-limitative are illustrative for the invention.

EXAMPLES

EXAMPLE 1

For the two comparative examples three solutions, the temperature of which was kept constant at 55° C., were used during the precipitation:

Solution 1: 1.5 liter of an aqueous solution containing 500 grams of silver nitrate.

Solution 2: 0.525 liter of an aqueous solution containing 126 grams of potassium bromide.

Solution 3: 0.975 liter of an aqueous solution containing 230.4 grams of potassium bromide and 0.5 grams of potassium iodide.

Emulsion 1 (comparative):

At the start the stirring rate was 150 rpm in the vessel and a UAg-value of −53 mV vs. a silver/silver chloride reference electrode was measured at 70° C. In the reaction vessel 2160 ml of demineralized water were present wherein 1.3 g of KBr and 12.5 g of inert bone gelatin were put.

Nucleation step:

35.9 ml of solutions 1 and 2 were introduced into a reaction vessel in 28 seconds using the double jet technique. 520 ml of an aqueous gelatinous solution (10%) were added to the reaction vessel 1 minute after the start of the nucleation stage.

First growth step:

A double jet precipitation was started after 10 minutes using solutions 1 and 2 which continued for 2 minutes 42 seconds. During this precipitation, a mV value of −30 mV was measured. The flowing rate of both solutions was equal to 7.5 ml per minute. After the said time, the flowing rate was increased linearly from 7.5 to 22.2 ml/min during 31 minutes and 36 seconds. During this time interval the same constant mV value was measured. 5 minutes later a neutralization phase was started.

Neutralization step:

During 5 minutes and 54 seconds solution 1 was run at a rate of 7.5 ml/min and a value of +70 mV was measured, whereafter the second growth step was started.

Second growth step:

During 41 minutes and 20 seconds solution 1 was injected in the reaction vessel at a linearly increasing rate, going from 7.5 ml per minute to 37.5 ml per minute at the end of the precipitation. The mV value was kept constant at +70 mV for the whole time while injecting solution 3 together with solution 1.

Emulsion 2 (comparative):

The same preparation method was followed as for the comparative Emulsion 1, except for the mV value of −61 mV vs. a silver/silver chloride reference electrode which was measured at 51° C., being the temperature in the vessel at the starting point.

Another difference was the addition time of an amount of 520 ml of an aqueous gelatinous solution (10%) which was added to the reaction vessel 21 minutes after the start of the nucleation stage, as after the said nucleation stage the temperature of the reaction vessel was linearly increased from 51° C. to 70° C. over a time interval of 20 minutes.

Washing and dispersing procedure.

After the emulsion precipitation was ended the pH value was lowered to 3.5 with diluted sulphuric acid and the emulsion was washed using demineralized water of 11° C. At 45° C. 160 grams of gelatin were added and the values of pH and pAg at 40° C. were adjusted to 5.5 and 8.15.

Emulsion 3 (invention):

The following solutions were prepared:

3 l of a dispersion medium (C) containing 0.3 moles of potassium bromide; 150 ml of 15% silica sol 'Kieselsol 500' (trademarked product of Bayer AG) and 7 ml of a 5% solution of co-stabilizing phosphonium compound (Phen)$_3$-$P^+$—$CH_2$—$CH_2OH.Cl^-$, wherein Phen represents phenyl was established at a temperature of 70° C. and pH was adjusted to 4.5;

a 2.94 molar silver nitrate solution (A);

a solution containing potassium bromide in a concentration of 2.94 mole per litre (B1);

a solution containing potassium bromide in a concentration of 2.35 mole per litre and 0.59 mole per litre of of potassium iodide (B2).

The initial UAg measured vs. a silver/silver chloride reference electrode was adjusted at −34 mV before starting the precipitation.

A nucleation step was performed by introducing solution A and solution B1 simultaneously in dispersion medium C both at a flow rate of 10 ml/min during 30 seconds. After a physical ripening time of 20 min the pH value was adjusted to a value of 3.0 and the solution was stirred for another 5 minutes.

Then a growth step was performed by introducing by a double let during 66 minutes solution A starting at a flow rate of 2.5 ml/min and linearly increasing the flow rate to an end value of 12.5 ml/min, and solution B1 at an increasing flow rate in order to maintain a constant mV-value −12 mV. During that time the phosphonium compound was poured into the reaction vessel in three steps during grain growth (after 26 minutes 35 seconds, 42 minutes 43 seconds and 55 minutes 19 seconds respectively) and an amount of 8 ml was added during each step.

After cooling of the vessel to about 40° C. dialysis was carried out in order to get a desalted solution having a conductivity of not more than 10 mS.

The thus obtained silver bromoiodide tabular emulsions having 2 mole % of iodide ions showed grain characteristics as defined hereinafter.

Emulsion 4 (invention):

The following solutions were prepared:

3 l of a dispersion medium (C) containing 0.3 moles of potassium bromide; 150 ml of 15% silica sol 'Kieselsol 500' (trademarked product of Bayer AG) and 51.6 ml of a 5% solution of co-stabilizing phosphonium compound (Phen)$_3$-$P^+$—$CH_2$—$CH_2OH.Cl^-$, wherein Phen represents phenyl was established at a temperature of 70° C. and pH was adjusted to 3.0;

a 2.94 molar silver nitrate solution (A);

a solution containing potassium bromide in a concentration of 2.94 mole per litre (B1);

a solution containing potassium bromide in a concentration of 2.35 mole per litre and 0.59 mole per litre of of potassium iodide (B2).

The initial UAg measured vs. a silver/silver chloride reference electrode was adjusted at −34 mV before starting the precipitation.

A nucleation step was performed by introducing solution A and solution B1 simultaneously in dispersion medium C both at a flow rate of 10 ml/min during 30 seconds. After a physical ripening time of 20 min 3.25 ml of a 10% solution of 3-carboxymethylthio-1-2-4-triazole and 20 ml of a 10% solution of imidazol were added and the pH value was adjusted to a value of 3.0. The solution was stirred for another 5 minutes. Then a growth step was performed by introducing by a double let during 66 minutes solution A starting at a flow rate of 2.5 ml/min and linearly increasing the flow rate to an end value of 12.5 ml/min, and solution B1 at an increasing flow rate in order to maintain a constant UAg-value of 5 mV.

After cooling of the vessel to about 40° C. 125 g of a 20% aqueous gelatinous solution was added, the emulsion was stirred for 5 minutes, the pH was adjusted to a value of 3.0 and polystyrene sulphonic acid was added in an amount to cause flocculation. The flocculate was washed three times with 2 l of demineralized water in order to get the emulsion desalted.

Emulsion 5 (invention):

The following solutions were prepared:

2.5 l of a dispersion medium (C) containing 0.131 moles of potassium bromide; 30 ml of 15% silica sol 'Kieselsol 500' (trademarked product of Bayer AG) and 20 ml of a 5% solution of co-stabilizing phosphonium compound $(Phen)_3$-$P^+$—$CH_2$—$CH_2OH.Cl^-$, wherein Phen represents phenyl was established at a temperature of 70° C. and pH was adjusted to 3.0;

a 2.94 molar silver nitrate solution (A);

a solution containing potassium bromide in a concentration of 2.94 mole per litre (B1);

a solution containing potassium bromide in a concentration of 2.35 mole per litre and 0.59 mole per litre of of potassium iodide (B2).

An initial UAg-value of −15 mV was measured vs. a silver/silver chloride reference electrode and the said UAg-value was adjusted at +200 mV before starting the precipitation by means of a silver nitrate solution (0.294 molar).

A nucleation step was performed by introducing solution A and solution B1 simultaneously in dispersion medium C both at a flow rate of 10 ml/min during 30 seconds. After a physical ripening time of 20 min 120 ml of a silica sol solution of "Kieselsol 500" (15%) and 80 ml of the same co-stabilizing phosphonium compound were added, together with 250 ml of demineralized water, and the pH value was adjusted to a value of 3.0. The solution was stirred for another 5 minutes. Then a growth step was performed by introducing by a double jet during 2 minutes and 38 seconds a solution A starting at a flow rate of 2.5 ml/min, whereafter a linearly increasing flow rate to an end value of 7.5 ml/min was applied during 32 minutes and 30 seconds. Solution B1 was added together with solution A at increasing flow rate in order to maintain a constant UAg-value of +8 mV.

After this growth step a physical ripening time of 5 minutes and 30 seconds was maintained before a second growth step was introduced. During 5 minutes and 54 seconds the solutions A and B2 were introduced in the reaction vessel: solution A at a constant flow rate of 2.5 ml per minute; solution B2 at a flow rate in order to keep the UAg-value constant at a value of +8 mV. Thereafter during 41 minutes and 22 seconds the flowing rate of solution A was increased to 12.5 ml per minute and the UAg-value was kept at +8 mV.

After cooling of the vessel to about 40° C. 125 g of a 20% aqueous gelatinous solution was added, the emulsion was stirred for 5 minutes, the pH was adjusted to a value of 3.3 and polystyrene sulphonic acid was added in an amount to cause flocculation. The flocculate was washed twice with 2 l of demineralized water in order to get the emulsion desalted.

The average diameter $d_{EM}$, average thickness "t", average aspect ratio AR were obtained from electron microscopic photographs: the diameter of the grain was defined as the diameter of the circle having an area equal to the projected area of the grain as viewed in the said photographs. In the Tables the average sphere equivalent diameter $d_M$ has been calculated from the values of "dEM" and "t" by means of the formula $$d_M=(3/2\times d_{EM}^2\times t)^{1/3}$$

From the data obtained for 1000 individual grains, the standard deviation v was calculated statistically and the value of the variation coefficient, defined the quotient of the standard deviations and average diameters was tabulated.

A separate analysis of the triangularly-shaped and the hexagonally-shaped crystals is given in Tables 1 and 2 and a comparison between ratios of both differently shaped crystals is given in Table 3.

TABLE 1

Evaluation of triangularly-shaped crystals in the Emulsions.

| Emulsion | $d_M$ (μm) | $d_{EM}$ | v | t (μm) | AR |
|---|---|---|---|---|---|
| 1 (comp) | 0.54 | 0.45 | 0.31 | 0.26 | 1.8 |
| 2 (comp) | 0.70 | 0.64 | 0.33 | 0.36 | 2.2 |
| 3 (inv) | 0.53 | 1.76 | 0.19 | 0.10 | 18 |
| 4 (inv) | 0.56 | 1.43 | 0.29 | 0.08 | 18 |
| 5 (inv) | 0.55 | 1.56 | 0.36 | 0.11 | 14 |

TABLE 2

Evaluation of hexagonally-shaped crystals in the Emulsions.

| Emulsion | $d_M$ (μm) | $d_{EM}$ | v | t (μm) | AR |
|---|---|---|---|---|---|
| 1 (comp) | 0.54 | 0.78 | 0.37 | 0.25 | 3.2 |
| 2 (comp) | 0.70 | 1.18 | 0.29 | 0.22 | 5.4 |
| 3 (inv) | 0.53 | 1.35 | 0.41 | 0.10 | 14 |
| 4 (inv) | 0.56 | 1.73 | 0.28 | 0.09 | 20 |
| 5 (inv) | 0.55 | 1.46 | 0.46 | 0.12 | 13 |

TABLE 3

Evaluation of ratio of triangularly-shaped to hexagonally-shaped crystals in the Emulsions.

| Emulsion | $d_M$ (μm) | % N (tr.) | % O (tr.) | $AR_{tr}/AR_{hex}$ |
|---|---|---|---|---|
| 1 (comp) | 0.54 | 12 | 4 | 0.56 |
| 2 (comp) | 0.70 | 14 | 5 | 0.41 |
| 3 (inv) | 0.53 | 53 | 66 | 1.33 |
| 4 (inv) | 0.56 | 43 | 34 | 0.90 |
| 5 (inv) | 0.55 | 24 | 26 | 1.11 |

N: numerical portion
O: surfacial portion

The following conclusions can be drawn from these Tables.

For the emulsions prepared according to this invention, as well as for the comparative emulsions (Emulsion 1 and 2) the sizes of the crystals are comparable.

The ratio of AR-values for triangular and hexagonal crystals leads to values comprised between 1.3 and 0.9 for crystals prepared according to the method of this invention.

This is an indication for a comparable thickness of triangular and hexagonal crystals present in an emulsion prepared by the method of this invention. Opposite thereto for the comparative emulsions the triangularly-shaped crystals are clearly thicker than the hexagonally-shaped ones: an average ratio of 2 makes the ratio of aspect ratios in this case be 0.4–0.6.

To summarize: an analogous growth mechanism for crystals prepared by the method of this invention is observed. Completely other phenomena are observed for comparative emulsions, which is indicative for a different growth mechanism of triangles and hexagons in that case.

As a consequence the procentual number of the triangles is remarkably higher for the emulsions prepared according to the method of this invention (25–55% vs. 10–15% for the comparative emulsions). Taking into account the crystal size and the aspect ratios the difference in projected surface area of the triangular crystals for the emulsions according to this invention is 25–70% vs. only 4–5% for the comparative emulsions.

During the redispersion of the emulsions an amount of inert gelatin was added so that the weight ratio of gelatin to silver halide (expressed as silver nitrate) was 0.25, the emulsion containing an amount of silver bromoiodide equivalent with 190 g of silver nitrate per kg.

The emulsions were chemically ripened with sulphur and gold at 47° C. for 4 hours in order to get an optimized relation between fog and sensitivity and were stabilized with 4-hydroxy-6-methyl-1,3,3*a*-tetrazaidene before coating on one side of a polyester support of 175 μm thickness. Therefor an optimum amount of toluene thiosulphonic acid was used as a weakly oxidizing predigestion agent before starting the chemical ripening, followed by the addition of 362.5 mg of anhydro-5,5'-dichloro-3,3'-bis(n.sulfobutyl)-9-ethyloxacarbo-cyanine hydroxide as spectral sensitizer, per mole of silver bromo-iodide. Further an amount of 200 mg of 1-p-carboxyphenyl-5-mercaptotetrazole was added.

The emulsion layers were overcoated with a protective layer. Amounts of coating solutions were the same in all cases in the emulsion layer as well as in the protective layer.

The following ingredients were added per mole of silver halide before coating:

785 mg of 4-hydroxy-6-methyl-1,3,3*a*,7-tetraazaindene as antifogging agent and stabilizer, 39 mg of phloroglucin as hardening accelerator 2.68 g of resorcin as hardening agent Demineralized water was added in order to reach a concentration corresponding to about 200 g of silver nitrate pro liter of coating solution.

A protective coating composition was prepared containing per liter the following ingredients in demineralized water:

35.4 g of an inert gelatin 37 g of silica sol with silica particles having an average diameter of from 7 to 10 nm 20 g of an aqueous dispersion of matting agent with a particle size diameter of 2 μm comprising 3.2% of polymethylmethacrylate and 10% of gelatin 225 mg of chromium acetate as a hardening agent 300 mg of ammoniumperfluoro-octanoate (FC143, trade name product from 3M) and 750 mg of N-polyoxyethylene-N-ethyl-perfluoro-octanesulfonamide (FC170C, trade name product from 3M) as surfactants 1500 mg of phenol as preserving agent 1000 mg of Mobilcer Q from MOBIL OIL as a lubricant Formaldehyde was added as a hardening agent.

Ratios of gelatin to silver nitrate for all emulsions were approximately 0.3 for all emulsions.

Due to the high amount of hardening agent said agent should be added to the coating composition of the protective topcoat layer just before coating so as to have a comparative water absorption.

On the opposite side a conventional antihalation backing layer was coated.

After coating and drying, the coated materials were exposed with with green light of 540 nm during 0.1 seconds using a continuous wedge and were processed during the 38 seconds processing cycle in the processing machine CURIX HT530 (Agfa-Gevaert trademarked name) with the following time (in seconds) and temperature (in °C.) characteristics:

| | | |
|---|---|---|
| loading: | 0.2 sec. | |
| developing: | 9.3 sec. | 35° C. in developer described below |
| cross-over: | 1.4 sec. | |
| rinsing: | 0.9 sec. | |
| cross-over: | 1.5 sec. | |
| fixing: | 6.6 sec. | 35° C. in fixer described below |
| cross-over: | 2.0 sec. | |
| rinsing: | 4.4 sec. | 20° C. |
| cross-over: | 4.6 sec. | |
| drying: | 6.7 sec. | |
| total | 37.6 sec. | |

Composition of Developer:

concentrated part:

| | |
|---|---|
| water | 200 ml |
| potassium bromide | 12 grams |
| potassium sulphite (65% solution) | 249 grams |
| ethylenediaminetetraacetic acid, sodium salt, trihydrate | 9.6 grams |
| hydroquinone | 106 grams |
| 5-methylbenzotriazole | 0.076 grams |
| 1-phenyl-5-mercaptotetrazole | 0.040 grams |
| sodiumtetraborate (decahydrate) | 70 grams |
| potassium carbonate | 38 grams |
| potassium hydroxide | 49 grams |
| diethylene glycol | 111 grams |
| potassium iodide | 0.022 grams |
| 4-hydroxymethyl-4methyl-1phenyl-3-pyrazolidinone | 22 grams |
| Water to make 1 liter | |

pH adjusted to 11.15 at 25° C. with potassium hydroxide.

For initiation of the processing one part of the concentrated developer was mixed with 3 parts of water.

No starter was added.

The pH of this mixture was 10.30 at 25° C.

Composition of Fixer:

concentrated part:

| | |
|---|---|
| ammonium thiosulfate (78% solution) | 661 grams |
| sodium sulphite | 54 grams |
| boric acid | 25 grams |
| sodium acetate-trihydrate | 70 grams |
| acetic acid | 40 grams |
| water to make 1 liter | |

pH adjusted with acetic acid to 5.30 at 25° C.

To make this fixer ready for use one part of this concentrated part was mixed with 4 parts of water. A pH of 5.25 was measured at 25° C.

In Table 4 data of sensitivity obtained after processing of materials containing emulsions Nos. 1, 4 and 5 respectively are given after exposure for an exposure time of $10^{-2}$ and $10^{-6}$ seconds respectively, wherein the product of exposure time and radiation intensity was held constant. The sensitivity S was determined at a density of 1 above fog and support density.

As the amount of light needed to reach a density of 1.00 above fog and support density is lower for the more light-sensitive materials the sensitivity is higher for lower values. Expressed as in Table 2 in 100 times log exposure this means that every decrease with a value of 30 is indicative for a material with a sensitivity that is twice as high.

The amount of silver coated (AGC), expressed as the equivalent amount of silver nitrate per square meter, is given additionally.

TABLE 4

| Em. No. | S (t = $10^{-2}$ s) | S (t = $10^{-6}$ s) | AGC |
|---|---|---|---|
| 1 (comp) | 100 | 100 | 6.71 |
| 4 (inv) | 140 | 170 | 5.76 |
| 5 (inv) | 138 | 175 | 5.67 |

The fact that differences in sensitivity between flash exposures and long time exposures are lower for triangularly-shaped emulsion crystals prepared by the method according to this invention can be interpreted to be due to a reduced dispersity of latent image centers for the said triangular-shaped crystals.

EXAMPLE 2

Emulsion 6 (invention):

The following solutions were prepared:

2.5 l of a dispersion medium (C) containing 0.13 moles of potassium bromide; 50 ml of 15% silica sol 'Kieselsol 500' (trademarked product of Bayer AG) and 15 ml of a 5% solution of co-stabilizing phosphonium compound $(Phen)_3\text{-}P^+\text{—}CH_2\text{—}CH_2OH.Cl^-$, wherein Phen represents phenyl was established at a temperature of 70° C. and pH was adjusted to 3.0;

a 2.94 molar silver nitrate solution (A);

a solution containing potassium bromide in a concentration of 2.94 mole per litre (B1);

a solution containing potassium bromide in a concentration of 2.49 mole per litre and 0.45 mole per litre of of potassium iodide (B2).

The initial UAg measured vs. a silver/silver chloride reference electrode was adjusted at −34 mV before starting the precipitation.

A nucleation step was performed by introducing solution A and solution B1 simultaneously in dispersion medium C both at a flow rate of 60 ml/min during 30 seconds. After a physical ripening time of 20 min 100 ml of a 15% solution of 'Kieselsol 500' and 30 ml of a 5% solution of the same phosphonium compound, together with 320 ml of demineralised water, were added and the pH value was adjusted to a value of 3.0. The solution was stirred for another 5 minutes. Then a growth step was performed by introducing by a double jet during 31 minutes 48 seconds solution A starting at a flow rate of 2.5 ml/min and linearly increasing the flow rate to an end value of 7 ml/min, and solution B1 at an increasing flow rate in order to maintain a constant UAg-value of +10 mV.

After a physical ripening time of 5 minutes and 30 seconds a second growth step was performed.

This second growth step was performed by introducing by a double jet during 5 minutes 54 seconds solution A starting at a flow rate of 2.5 ml/min and after that time linearly increasing the flow rate to an end value of 12.5 ml/min during 41 minutes 22 seconds, and solution B2 at an increasing flow rate in order to maintain a constant UAg-value of +10 mV.

After cooling of the vessel to about 40° C. 125 g of a 20% aqueous gelatinous solution was added, the emulsion was stirred for 5 minutes, the pH was adjusted to a value of 3.0 and polystyrene sulphonic acid was added in an amount to cause flocculation. The flocculate was washed twice with 4 l of demineralized water in order to get the emulsion desalted.

Emulsion 7 (invention):

Same preparation as for Emulsion 6, except for the presence in the 2.5 l of a dispersion medium (C) of 67 ml of 15% silica sol 'Kieselsol 500' (trademarked product of Bayer AG) and 40 ml of a 5% solution of co-stabilizing phosphonium compound and addition after the first physical ripening time of 20 min, following the nucleation step, of 133 ml of a 15% solution of 'Kieselsol 500' and 80 ml of a 5% solution of the same phosphonium compound, together with 237 ml of demineralized water, were added and the pH value was adjusted to a value of 3.0.

Emulsion 8 (invention):

Same preparation as for Emulsion 6, except for the presence in the 2.5 l of a dispersion medium (C) of 33 ml of 15% silica sol 'Kieselsol 500' (trademarked product of Bayer AG) and 15 ml of a 5% solution of co-stabilizing phosphonium compound and addition after the first physical ripening time of 20 min, following the nucleation step, of 67 ml of a 15 solution of 'Kieselsol 500' and 30 ml of a 5% solution of the same phosphonium compound, together with 353 ml of demineralized water, were added and the pH value was adjusted to a value of 3.0.

A separate analysis of the triangularly-shaped and the hexagonally-shaped crystals is given in Tables 5 and 6, just as in Tables 1 and 2 and a comparison between ratios of both differently shaped crystals is given in Table 7, just as for Table 3.

TABLE 5

Evaluation of triangularly-shaped crystals in the Emulsions.

| Emulsion | $d_M$ (μm) | $d_{EM}$ | v | t (μm) | AR |
|---|---|---|---|---|---|
| 6 (inv) | 0.59 | 0.98 | 0.24 | 0.14 | 6.9 |
| 7 (inv) | 0.55 | 0.95 | 0.24 | 0.13 | 7.6 |
| 8 (inv) | 0.56 | 0.94 | 0.26 | 0.11 | 8.3 |

TABLE 6

Evaluation of hexagonally-shaped crystals in the Emulsions.

| Emulsion | $d_M$ (μm) | $d_{EM}$ | v | t (μm) | AR |
|---|---|---|---|---|---|
| 6 (inv) | 0.70 | 1.23 | 0.22 | 0.15 | 8.4 |
| 7 (inv) | 0.61 | 1.12 | 0.24 | 0.12 | 9.2 |
| 8 (inv) | 0.67 | 1.24 | 0.29 | 0.13 | 9.5 |

TABLE 7

Evaluation of ratio of triangularly-shaped to hexagonally-shaped crystals in the Emulsions.

| Emulsion | % N (tr.) | % O (tr.) | $t_{tr}/t_{hex}$ | $AR_{tr}/AR_{hex}$ | COSI | SISI |
|---|---|---|---|---|---|---|
| 6 (inv) | 52 | 45 | 0.79 | 0.82 | 0.15 | 0.06 |
| 7 (inv) | 41 | 46 | 0.85 | 0.82 | 0.10 | 0.10 |
| 8 (inv) | 51 | 42 | 0.76 | 0.87 | 0.10 | 0.12 |

N: numerical portion
O: surfacial portion
COSI: ratio by weight of phosphonium co-stabilizer to silica
SISI: ratio by weight of silica to silver*
*: the amount of silver is expressed as the equivalent amount of silver nitrate.

The following conclusions can be drawn from these Tables 5, 6 and 7.

For the emulsions prepared according to this invention, differing in COSI and SISI, the sizes of the crystals are comparable.

For the emulsions prepared according to the method of this invention, the ratio values of $d_{EM}$ are situated around a value of about 0.8, which is within the range for the inventive emulsions from Example 1, wherein the thickness ratio of triangular tabular crystals to hexagonal tabular crystals is from 1.3 to 0.7.

Analogously the ratio of AR-values for triangular and hexagonal crystals leads to values of about 0.8 for crystals prepared according to the method of this invention. This again is an indication for a comparable thickness of triangular and hexagonal crystals present in an emulsion prepared by the method of this invention. No remarkable differences can be mentioned for inventive emulsions, prepared within the ranges of COSI and SISI as for the emulsions 6 to 9.

To summarize: an analogous growth mechanism for crystals prepared according to the method of this invention is observed within ranges of COSI and SISI as set forth above.

We claim:

1. Light-sensitive silver bromide or silver bromoiodide emulsion comprising silver bromide or silver bromoiodide tabular triangular grains and tabular hexagonal grains: said tabular triangular grains having an average grain thickness of less than 0.3 μm, an average crystal diameter of at least 0.6 μm; an average aspect ratio of at least 2:1; a variation coefficient of less than 40%, said tabular triangular grains accounting for a total projective area of at least 30%; characterized in that a procentual number of tabular triangular grains is present from 25% to 55% and in that a thickness ratio $t_{-tr}/t_{-hex}$ of triangular tabular grains to hexagonal tabular grains is from 1.3 to 0.7.

2. Light-sensitive silver bromide or silver bromoiodide emulsion according to claim 1, said tabular triangular grains having an average aspect ratio of at least 5:1; a variation coefficient of less than 25%, said tabular triangular grains accounting for a total projective area of at least 50%.

3. Light-sensitive silver bromide or silver bromoiodide emulsion according to claim 1, wherein the average grain thickness of said tabular triangular grains is not more than 0.2 μm.

4. Light-sensitive silver bromide or silver bromoiodide emulsion according to claim 1, wherein the average aspect ratio of said tabular triangular grains is at least 8:1.

5. Light-sensitive silver bromide or silver bromoiodide emulsion according to claim 1, wherein the said tabular triangular emulsion grains are accounting for a total projective area of at least 70%.

6. Light-sensitive silver bromide or silver bromoiodide emulsion according to claim 1, wherein the said tabular triangular emulsion grains are accounting for a total projective area of at least 90%.

7. Light-sensitive silver halide photographic material having on at least one side of a support, at least one hydrophilic colloid layer including at least one light-sensitive layer, characterized in that said light-sensitive layer is coated from at least one silver bromide or silver bromoiodide emulsion according to claim 1.

8. Method for preparing a light-sensitive silver bromide or silver bromoiodide emulsion, according to claim 1, comprising the steps of:

precipitating silver bromide or silver bromoiodide by means of a double-jet or triple-jet technique applied to aqueous solutions of silver nitrate and halide salts in the presence of colloidal silica as a protective colloid, controlling nucleation and growth steps by means of variable flow rates of aqueous solutions of silver nitrate and halide salts and constant pAg-values within the range from 9.5 to 8.0 during said steps, at least one physical ripening step between at least nucleation and first growth step, desalting reaction medium and redispersing silver halide emulsion, and chemically ripening the silver bromide or silver bromoiodide grains.

9. Method according to claim 8, wherein as a protective colloid, use is made of colloidal silica, in the presence of a phosphonium compound, wherein a ratio by weight of said to the said protective colloid is between 0.03 and 0.50.

10. Method according to claim 8, wherein as a protective colloid, use is made of colloidal silica, in the presence of a phosphonium compound, wherein a ratio by weight of said phosphonium compound, to the said protective colloid is between 0.05 and 0.30.

* * * * *

UNITED STATES PATENT AND TRADEMARK OFFICE

CERTIFICATE OF CORRECTION

PATENT NO. : 5,733,715
DATED : March 31, 1998
INVENTOR(S) : Ann Verbeeck et al

It is certified that error appears in the above-indentified patent and that said Letters Patent is hereby corrected as shown below:

The U.S. Provisional application data is missing from the heading. This should read:
-- Related U.S. Application Data
[60] Provisional application No. 60/003,587, Sep. 12, 1995. --

Column 4, line 2, "the "Snowrex" silica sols" should read -- the "Snowtex" silica sols --, Column 4, line 14, "$NH_4$-ions are thereby excluded" should read -- $NH_4^+$-ions are thereby excluded --, Column 4, line 33, "provided by an organic iodide salts" should read -- provided by anorganic iodide salts --, Column 5, line 48, "A hererogenous halide distribution" should read -- A heterogenous halide distribution --, Column 6, line 35, "gold-tellurium ripenets" should read -- gold-tellurium ripeners --, Column 8, line 54, "comprises at leas% one" should read -- comprises at least one --, Column 9, line 19, "(meth)acrylares, and styrene" should read -- (meth)acrylates, and styrene --, Column 13, line 13, "UAg-value of 5 mV." should read -- UAg-value of +5 mV. --,

UNITED STATES PATENT AND TRADEMARK OFFICE

CERTIFICATE OF CORRECTION

PATENT NO. : 5,733,715

DATED : March 31, 1998

INVENTOR(S) : Ann Verbeeck et al

It is certified that error appears in the above-indentified patent and that said Letters Patent is hereby corrected as shown below:

Column 18, lines 37/38, "of a 15 solution of" should read -- of a 15% solution of --, Claim 9, column 20, lines 45/46, "weight of said to the said" should read -- weight of said phosphonium compound to the said --.

Signed and Sealed this

Twenty-fifth Day of August, 1998

Bruce Lehman

*Attest:*

BRUCE LEHMAN

*Attesting Officer*

*Commissioner of Patents and Trademarks*